United States Patent [19]

Wüthrich

[11] Patent Number: 4,669,393

[45] Date of Patent: Jun. 2, 1987

[54] CASHIER'S SAFE

[75] Inventor: Werner Wüthrich, Gümligen, Switzerland

[73] Assignee: Autelca Ag., Gumligen, Switzerland

[21] Appl. No.: 794,457

[22] Filed: Nov. 4, 1985

[30] Foreign Application Priority Data

Nov. 5, 1984 [CH] Switzerland ..... 5290/84

[51] Int. Cl.[4] ..... E05G 1/00

[52] U.S. Cl. ..... 109/48; 271/303; 109/47

[58] Field of Search ..... 109/6, 7, 24.1, 47, 109/48, 49, 45, 66; 133/4 R, 4 A; 312/97, 268; 271/275, 297, 303, 305

[56] References Cited

U.S. PATENT DOCUMENTS

| | | | |
|---|---|---|---|
| 4,080,908 | 3/1978 | Bianco | 109/66 |
| 4,227,757 | 10/1980 | Ringe | 109/47 |
| 4,365,700 | 12/1982 | Arimoto | 133/4 R |
| 4,441,704 | 4/1984 | Uchida | 271/303 |
| 4,473,157 | 9/1984 | Hirose | 271/305 |

FOREIGN PATENT DOCUMENTS

| | | | |
|---|---|---|---|
| 140839 | 10/1984 | European Pat. Off. | 109/48 |
| 3240955 | 5/1984 | Fed. Rep. of Germany | 109/48 |

*Primary Examiner*—Carl D. Friedman
*Assistant Examiner*—Naoko N. Slack
*Attorney, Agent, or Firm*—Brady, O'Boyle & Gates

[57] ABSTRACT

A cashier's safe for banks is disclosed in which money cassettes in vertical columns are held in storage spaces on rotatable racks disposed on opposite sides of the vertical traveling path of a cassette carrier. Each cassette selectively can be brought up to a money receiving and withdrawal point at the top of the safe and returned to its proper storage space by the cassette carrier. Cassettes containing larger sums of money are moved more slowly to the withdrawal point than those containing lesser sums to reduce the probability of robbery. Storage units in the safe for bank notes include bank note storage belts wound on storage drums. The storage units are located on opposite sides of a vertical covered belt conveyor for bank notes which transfer them from the storage units to a bank note receiving and withdrawal point at the top of the safe. Bank note switches associated with the storage units are provided along the covered belt conveyor. The cashier's safe may be automated and a microprocessor may be employed to control the receiving or issuance of money in specified denominations and amounts.

5 Claims, 6 Drawing Figures

CASHIER'S SAFE

BACKGROUND OF THE INVENTION

1. Technical Field

The present invention relates to a cashier's safe for use by bank tellers and more parrticularly to a cashier's safe by means of which large sums of money can be withdrawn from the safe only following a predetermined time delay interval. Smaller sums of money can be withdrawn from the safe more rapidly. The delayed withdrawal of larger sums discourages and lessens the probability of a bank robbery because such robberies, in order to be successful, must be executed rapidly.

2. The Prior Art

A turntable-type security cashier's desk is known in the prior art, the turntable being sub-divided into money compartments and having a cover. Money is taken by a cashier or teller from one compartment only of the turntable during a dwell period of the turntable while that money compartment is in an uncovered position. Because of the very slow turning speed of the turntable, rapid withdrawal of the contents of the several turntable compartments is impossible (German Pat. No. 2,347,749). In addition, the total amount of money available for distribution and its separation into bank notes and coins of various denominations is substantially restricted by the desk or table area. Furthermore, deep turntable compartments having small bottom areas makes withdrawal of money difficult. Undesirable delays also occur with the prior art device when money is to be distributed among the several turntable compartments. Automatic issuance of a desired number of bank notes of specific denominations is impossible, and the same is true for automatic distribution of money into the turntable compartments of the prior art device.

SUMMARY OF THE INVENTION

The present invention has for one of its objects to provide a remedy for the above-noted drawbacks of the prior art. More particularly, the invention provides a cashier's safe wherein the amount of money made available and its sub-division is not limited by the number of compartments which can be accommodated on a table surface, such as a turntable. Moreover, in accordance with the present invention, the speeds of withdrawal and depositing of partial amounts of money can be varied in the interest of efficiency and security.

A great advantage of the present invention resides in the arrangement of the depository cassettes in superposed relationship in vertical columns, requiring only a minimum amount of space within the cashier's safe. By virtue of this arrangement, large amounts of money divided into required denominations can be stored and made available in a small surface area of the safe. The sizes of the individual cassettes can be graduated. The speed of the cassette carrier can be regulated to be slower for cassettes having larger amounts of money than for those having smaller amounts. Similarly, the velocity of the covered belt conveyor of bank notes can be regulated to be faster or slower in the direction leading to and away from the bank note receiving and withdrawing point of the cashier's safe. This flexibility of operation enables more rapid and efficient deposit of money and also allows a more rapid withdrawal of small amounts of money and a delayed withdrawal of larger amounts. This delayed withdrawal feature greatly discourages potential robbers who expect that an alarm will be triggered after a very short time interval, making escape much more difficult during a longer time interval. If the perpetrator knows that he can seize only a relatively small amount of money in a short time period because of technical measures which cannot be influenced by him or by the bank teller, his interest in the robbery will fade. If the robber persists in spite of this, the material loss will be lessened since only a small amount can be withdrawl in the brief time period.

The cashier's safe according to the present invention permits extensive automation of money storage and withdrawal under control of a microprocessor. In this regard, the speed of the cassette carrier can be controlled automatically. The bank note storage and issuing device can be equipped with a separator, and the switches of the device can be regulated by the microprocessor so that the bank notes of a bundle being introduced into the safe are automatically distributed to the storage units for their particular values or denominations. Similar controls make possible the automatic withdrawal of bank notes in desired denominations from the associated storage units and make the notes available at the withdrawal point of the safe.

In the case of the cassette depository, bank notes and coins are placed by hand in the cassettes and must be manually removed therefrom and counted. However, the cassette depository has the advantage over the bank note storage means in that it can store substantially more money per space unit.

In the cashier's safe according to the invention, the advantages of both types of depositories are combined and their disadvantages can be avoided in that the bank note depository is utilized for the introduction and withdrawal of bank notes only, and the cassette storage means is utilized for "refilling" the bank note storage means, if necessary, as where one bank note storage unit contains too few notes, or the depositing of a bundle of notes would exceed the storage capacity of a note storage unit. Since the number of cassettes will normally exceed the number of bank note storage units, the cassette depository will also be utilized for storage currencies used less frequently and which do not warrant the use of a special storage unit.

Other objects and advantages of the invention can be derived from the following detailed description with reference to the accompanying drawings.

DESCRIPTION OF THE PREFERRED EMBODIMENT

Figure 1:
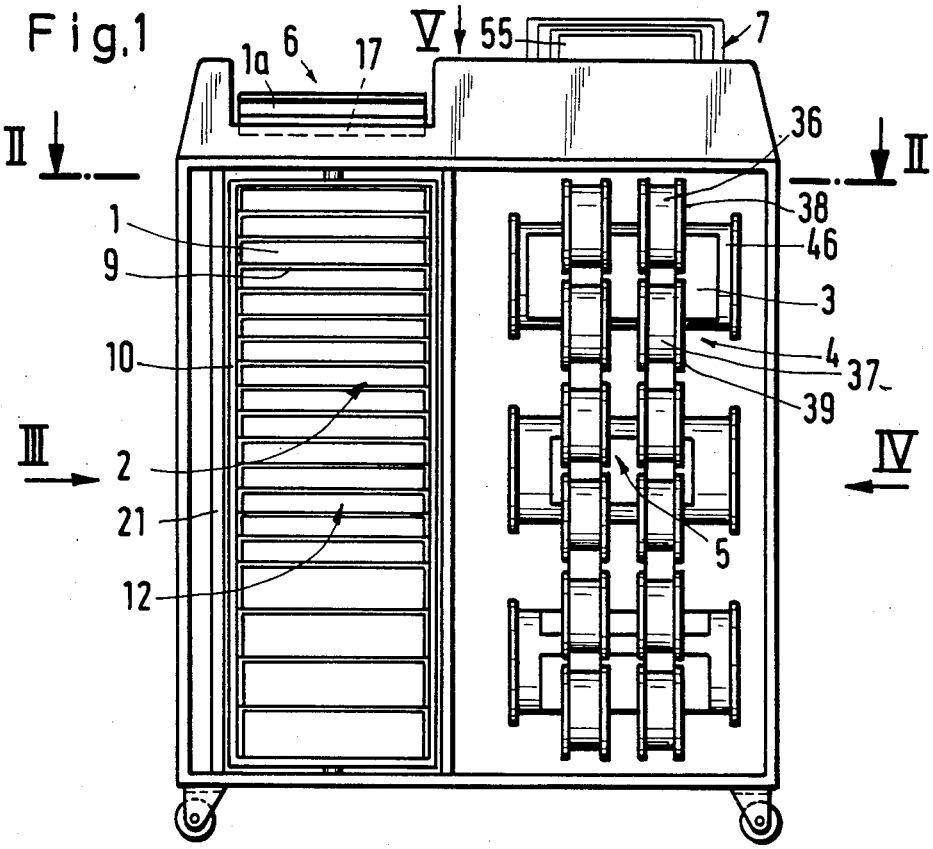
FIG. 1 is a front elevation of a cashier's safe according to the present invention with a front wall removed for clarity, looking in the direction I in FIGS. 2 through 5.

Referring to the drawings in detail wherein like numerals designate like parts, a cashier's safe for use at cashier's windows, at banks or other financial institutions, is illustrated.

Bank notes and/or coins in various denominations are stored in numerous cassettes 1 of a cassette depository 2, and bank notes 3 are stored in preferably six storage units 4 of a bank note storage means 5. The cassettes 1 are made accessible at a money receiving and withdrawal point 6 while bank notes taken from the storage units 4 of the depository 5 are made available at a bank note receiving and withdrawal point 7 of the safe.

Figure 2:
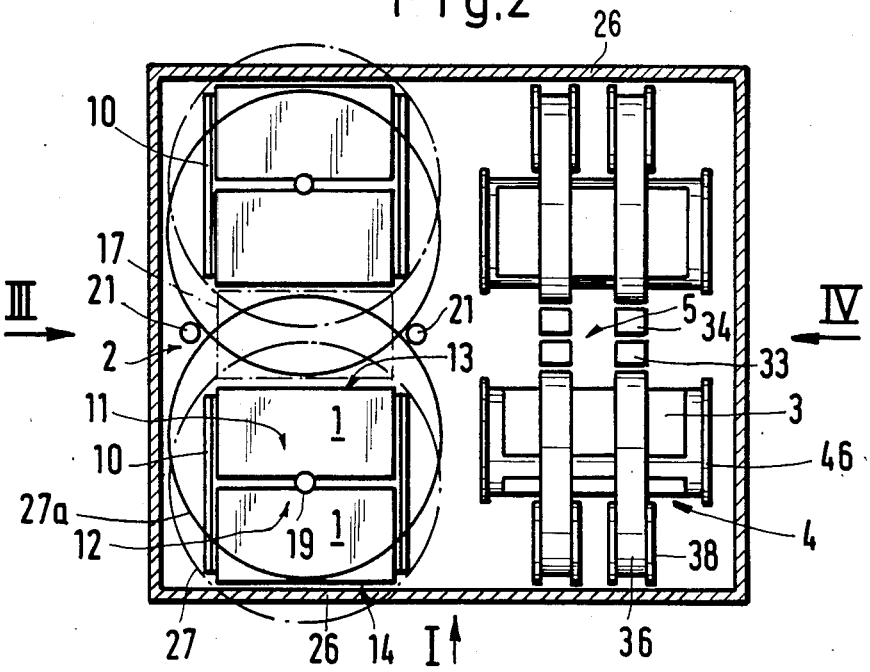
FIG. 2 is a horizontal section taken on line II—II in FIGS. 1, 3 and 4.
Figure 3:
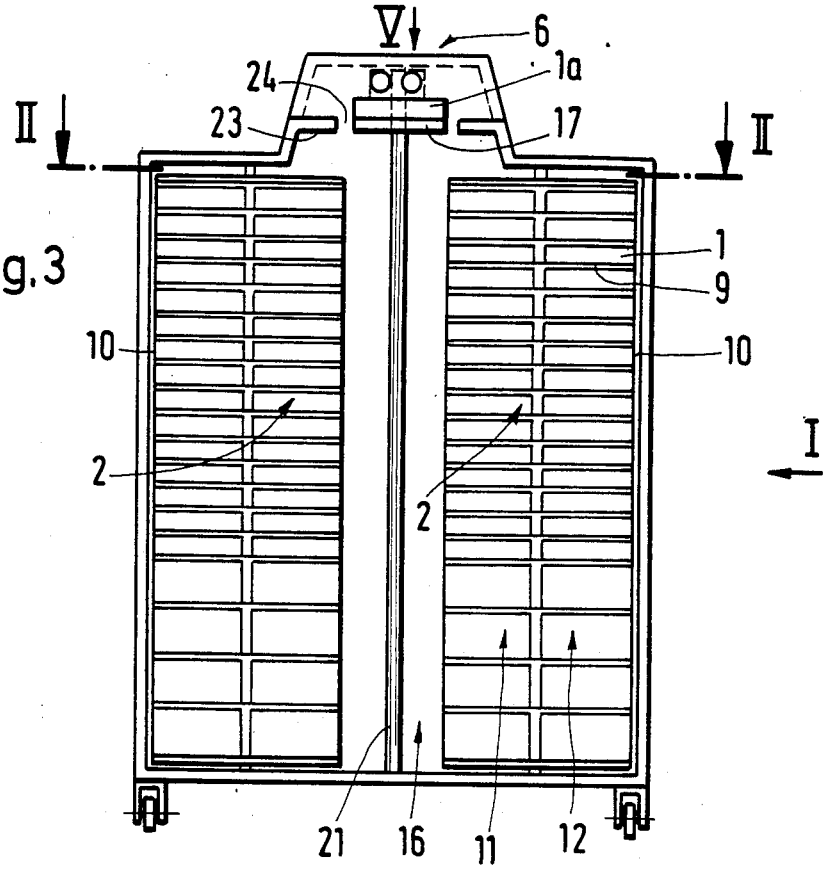
FIG. 3 is a side elevation of the cashier's safe looking in the direction III in FIGS. 1, 2 and 5, with a side wall removed for clarity.

A separate storage space 9 is provided for each cassette 1 in the cassette depository 2, (FIGS. 1, 2 and 3). The storage spaces 9 are formed on two vertically elongated racks 10 in each of which the storage spaces 9 are in superposed relationship in two rows or columns 11 and 12 arranged side-by-side, each row or column being accessible at one or two mutually opposed rack sides 13 and 14 for the insertion and extraction of the cassettes 1 into and out of each rack 10. The racks 10 are located on opposite sides of the vertical traveling path 16 of a cassette carrier 17 (FIG. 3) so that one of the accessible sides 13 or 14 of a rack 10 opposes one of the accessible sides of the other rack 10. Each rack 10 can be rotated about a central vertical axle 19 through 180° so that each rack side 13 and 14 can be turned toward the traveling path 16 of the cassette carrier 17. A suitable drive means (not shown) for rotating each cassette rack 10 is provided.

The cassette carrier 17 is movable along two vertical guides 21 (FIGS. 2 and 3) by a suitable drive mechanism (not shown) to the top position shown in FIG. 3 where the particular cassette 1a carried thereby is at the money depositing and withdrawing point 6 of the safe. The carrier 17 can also be driven to various positions along its movement path 16 so as to be adjacent to any selected cassette storage space 9. By means of a cassette shifting device (not shown) provided at the cassette carrier 17, a cassette 1 can be pulled from its storage space 9, beside which the cassette carrier has been moved, onto the carrier, or a cassette 1 on the carrier 17 can be pushed into its storage space 9. In order to pull a cassette from its storage space 9 onto the cassette carrier 17, the cassette shifting device can be equipped with an electromagnetic which, when energized, attracts a magnetic armature attached to the cassette; or the cassette can be formed of sheet iron so that it will be attracted and pulled onto the carrier 17. The cassettes 1 all have the same horizontal areas but have differing storage capacities because they have different heights. The velocity of the cassette carrier along its traveling path 16 can be regulated so that cassettes with contents of greater value are conveyed more slowly toward the withdrawal point 6 for security reasons, previously discussed.

The money receiving and withdrawal point 6 at the top of the cashier's safe is separated from the traveling path 16 along which the cassette carrier 17 moves by a horizontal wall 23 having an opening 24. In the position of the cassette carrier 17 shown in FIG. 3, the carrier 17 seals the opening 24. In order to keep the opening 24 closed to prevent access to the uppermost cassettes while the cassette carrier 17 is positioned at a lower level along the path 16 and below the wall 23, a closure slide (not shown) can be provided to cover the opening 24 while the cassette carrier 17 is below the wall 23. A device (not shown) can be arranged at the money receiving and withdrawing point 6 to automatically open each cassette which has arrived at the point 6 and to close the same again automatically before the downward movement of the cassette carrier 17 begins.

In order to efficiently use the space inside of the cashier's safe for the cassette depository 2, each of the racks 10 is disposed close to the forward or rear wall 26 of the cashier's safe, as shown in FIG. 2. In this position, the circles 27 transcribed by the racks 10 during their rotation project beyond the walls 26. To insure the rotatability of the racks 10 on their axles 19, each of these axles can be moved away from the adjacent wall 26 to a position where the circles 27a transcribed by the racks is inwardly of and close to the adjacent wall 26. For this purpose, the upper and lower ends of each axle 19 can be attached to two crank arms (not shown) which are rotatable about an axis common to both of them. To avoid interference of the cassette carrier 17 with rotation of the racks 10, the carrier 17 is elevated above the racks 10 (FIG. 3) or lowered to a point below the racks. To permit rotation of the racks 10 in a central position of the cassette carrier 17, the racks 10 could be provided with recesses into which the carrier 17 can extend during rotation of the racks.

Figure 4:
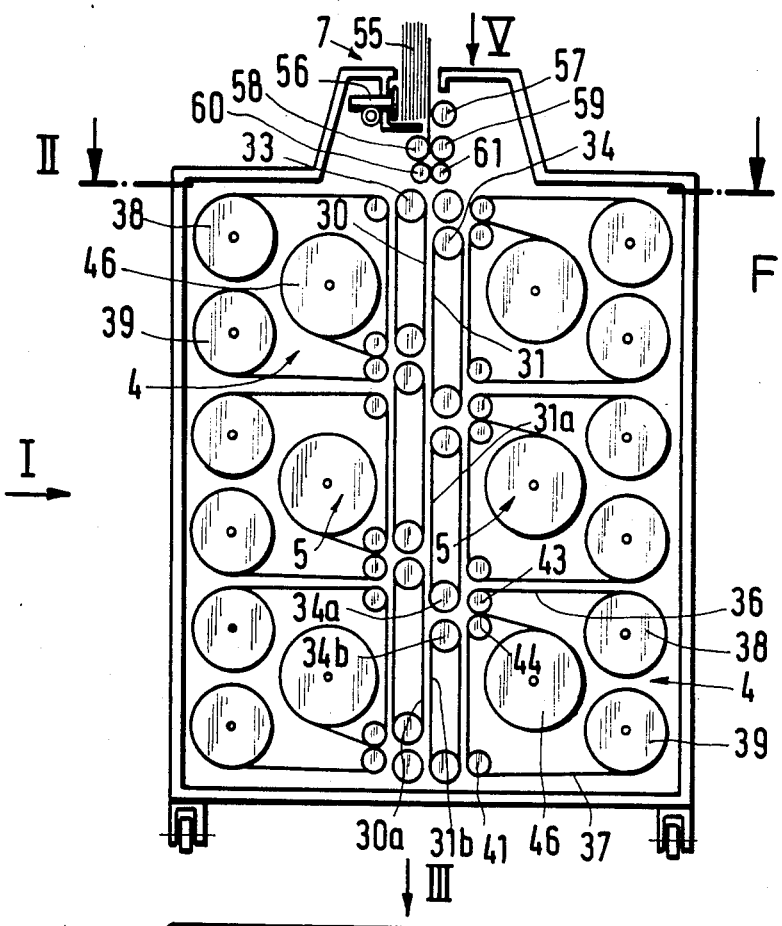
FIG. 4 is a side elevation viewed in the direction IV in FIGS. 1, 2 and 5 with a side wall removed for clarity.
Figure 5:
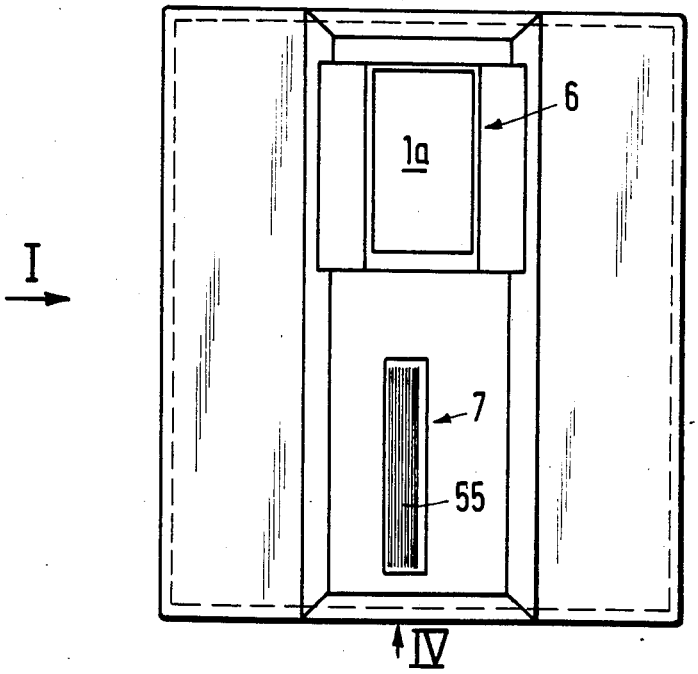
FIG. 5 is a plan view of the safe.

Three of the six storage units 4 are located in superposed relationship within the bank note depository 5 (FIGS. 1, 2 and 4) on each of the two sides of the vertical conveyor path of a bank note conveyor 30, 31 (FIG. 4). The bank note depositing and withdrawal point 7 is provided at the upper end of the bank note conveyor. The bank note conveyor is a covered belt conveyor, the bank notes being frictionally held between jointly traveling conveyor belts 30 and 31 and being transported thereby. Each of these conveyor belts 30 and 31 is subdivided into two belts running side-by-side (FIG. 1), traveling about correspondingly split guide rollers 33 and 34.

Each storage unit 4 operates with two storage belts 36 and 37 (FIG. 4), each of which is subdivided into two belts running side-by-side, in the same manner that the conveyor belts are subdivided. Each divided storage belt 36 and 37 is attached at one end to a storage roller 38 and 39, respectively, equipped with flanges, and is more-or-less wound up thereon depending on operating conditions. The storage belt 37 is guided over a guide roller 41 and around a roll 44 of a pair of rolls 43 and 44 in the roll nip of the latter. The other storage belt 36 is passed around the roll 43 and is likewise in the nip of the pair of rolls 43 and 44. The two storage belts 36 and 37 come into contact with each other while traveling through this roll nip; then they travel together to a storage drum 46 where they are jointly attached and on which they are wound up together, more-or-less, depending on the operating conditions of the storage unit 4. For storing purposes, the storage drum 46 is driven in the wind-up direction. During such operation, bank notes introduced into the described roll nip are frictionally seized between the traveling belts 36 and 37, which leave the roll nip, and are wound up together with the two storage belts on the drum 46 (bank notes 3 in FIGS. 1 and 2). In order to issue stored bank notes 3, the storage rollers 38 and 39 are driven in the wind-up direction whereby the storage belts 36 and 37 are unwound from the storage drum 46 together with the bank notes 3. The belts 36 and 37 travel to the nip of the pair of rolls 43 and 44, and the bank notes are conveyed out of the roll nip. During storing, the storage rolls 38 and 39 are braked, and during issuance of bank notes, the storage drum 46 is braked. Both processes can be accomplished by providing an electric motor for driving each storage roll 38 and 39 and a further electric motor for driving the storage drum 46 and these motors are, in each case, slightly energized to produce a braking effect. The motors (not shown) are of the external rotor type.

Each of the conveyor belts 30, 31 of the covered belt conveyor includes belt sections, e.g. 30*a*, 31*a* and 31*b*, following one another in the vertical conveying direction and being guided by pairs of guide rollers (FIG. 4). In this arrangement, a guide roller 34*a* of a belt section 31*a* is located beside a roll 43 of the pair of rolls 43, 44 of a storage unit 4, and a guide roller 34*b* of the belt section 31*b* below the belt section 31*a* is located beside the other roll 44 of the pair of rolls of the same storage unit 4 (FIG. 4).

Figure 6:
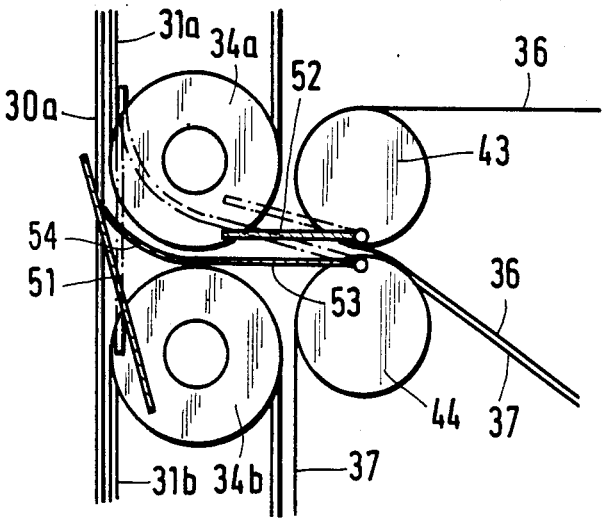
FIG. 6 is an enlarged elevational view of a bank note switch.

Each storage unit 4 is associated with a switch 51, 53, 54 and 52 (FIG. 6). In a first switch position shown in phantom lines, bank notes conveyed between the belts 30*a* and 31*a* are conducted to the directly adjoining conveyor section constituted by belt sections 30*a* and 31*b*, or vice-versa. In a second switch position shown in full lines, bank notes being conveyed between belt sections 30*a* and 31*a* are conducted into the nip of the pair of rolls 43 and 44, or, conversely, are conducted from this roll nip to transport positions between the belt sections 30*a* and 31*a*. The swtich has first guide members of three portions 51, 53 and 54 and second guide members 52 which are jointly pivotable; these switch members being provided in triplicate, one behind the other, only one being shown, and arranged so that two first guide members 51, 53 and 54 and two second guide members 52 guide he bank notes by their ends laterally projecting beyond the belt sections 30*a*, 31*a* and 31*b*, respectively, and one first and one second guide member guide the bank notes in their centers in the belt interspace formed by the subdivision of the belts. The guide surface of portion 51 of the first guide members 51, 53, 54 extend, in the first switch position, in the plane of the conveying faces of the belt sections 31*a* and 31*b*, wherein portion 54 of the first guide members 51, 53 and 54, as well as the second guide members 52, which are arranged to guide the bank notes at their centers, extend into a circumferential groove, which is formed in guide roller 34*a* by its subdivision corresponding to the subdivision of the conveyor belts 30, 31 and 31*a*, 31*b* into belts running side-by-side. In the second switch position, the portion 51 intersects the plane of belt section 30*a* at a point spaced from the guide roller 34*a*, the portion 51 of that first guide member which is arranged to guide the bank notes at their centers extends into a circumferential groove formed in guide roller 34*b* by its subdivision coresponding to the subdivision of the conveyor belts. In this second switch position, the second guide members 52 and the portion 53 of first guide members 51, 53, 54, parallel to the second guide members, form a guide means conducting the bank notes from the interspace between the guide rollers 34*a* and 34*b* into the roll nip of the roll pair 43, 44, or vice-versa, the portion 54 of the first guide members 51, 53, 54 being curved with a radius that exceeds somewhat the radius of guide roller 34*a*, extending in this position coaxially to the guide roller 34*a* and conducting the bank notes around the guide roller 34*a*. The portion 51 adjoins the free end of the portion 54. Portions 51, 53 and 54 are suitably formed integrally with each other. The first and second guide members 51, 53, 54 and 52, respectively, are pivotally supported in the proximity of the nip of the roll pair 43, 44. The guide surfaces of the guide members 51, 53, 54 and 52 are smooth, and the axial distance of the roll 43 from the guide roller 34*a*, or of roll 44 from guide roller 34*b*, and also the mutual axial distance of the guide rollers 34*a* and 34*b*, is so much smaller than the size of the bank notes of the smallest form to be stored, measured in the conveying direction, that their conveyance in the region of the switch is assured. For this purpose, the bank notes must always be held firmly by pressure, with adhesive-like friction, in the guiding zone of the switch, either between the belt sections 30*a* and 31*a* (in the first switch position) or between belt sections 30*a* and 31*b* (in the second switch position), or between the storage belts 36 and 37, respectively.

The storage units 4 of equal size in the present drawings can also have different sizes to provide different storage capacities. The velocity of the belts 30, 30*a*, 31, 31*a*, 31*b* is greater in the direction leading away from the bank note entrance and discharge point 7 and toward the storage drum 46 than in the opposite direction.

At the bank note receiving and discharging point 7, bank notes introduced in a bundle 55 (FIG. 4) are urged by a plunger 56 against a conveyor roller 57, and are conveyed from there to a separator 58, 59, followed by a thickness control means 60, 61, from which the individual notes pass to the covered belt conveyor 30, 31. The separating device consists of a fixed roll 58 of ceramic material, and a driven transport wheel 59. The roll 58 is turned a certain distance from time-to-time so that a new peripheral portion replaces a worn portion of the roll. The thickness regulator has two driven metallic rolls 60, 61 in contact with each other forming a roll nip. The length of the roll nip is somewhat greater than the length of the bank notes transversely of their path of movement, and the nip width is adapted to the thickness of the bank notes. A bank note of relatively large thickness causes the rolls 60 and 61 to separate somewhat, thereby interrupting a control circuit in order to differentiate among bank notes of varying thicknesses. Several pairs of the thickness regulating or sensing rolls 60 and 61 can be utilized. It is also possible to provide light barriers (not shown) to count and differentiate bank notes having various formats.

By means of a bank note receiving and withdrawal point 7 equipped as described above, the bank note switch elements 51, 52, 53 can be regulated so that deposited bank notes are automatically distributed to storage units 4, for specific amounts and denominations.

The cashier's safe cooperates with a computer, especially with a microprocesser, for controlling the automatic storage and issuance of bank notes, and storing this procedure together with the money receiving and withdrawing processes to be put into a terminal (in each case with cassette designation), so that the balance in each storage unit 4 and in each cassete 1 can be determined by interrogation. In this connection, a signaling device can be provided indicating the facts that a specific minimum balance is no longer present and that a storage unit 4 is about to "overflow". The microprocessor can be designed so that it will seek the suitable storage units 4 when the currency, the amount to be received or issued, and the denominations, are fed into the terminal, and will regulate the switches and control the cassette carrier drive in order to place the proper cassette at the money receiving and withdrawal point 6.

The cashier's safe can be placed between two tellers' windows and utilized by both tellers manning these windows in a bank. In this case, a terminal is provided for each teller, which can be used to control only the storage units and storage spaces associated with a particular teller. In the cashier's safe illustrated, as an example, the storage units 4 on one side of the covered belt conveyor 30, 31 and the storage spaces 9 of one of the racks 10 can be associated with one teller's window, and the storage units 4 on the other side of the covered belt conveyor, as well as the storage spaces 9 of the other rack 10, could be associated with the other teller's window. Any other correlation can be realized by the program of the microprocessor. In this manner, associations are possible which can be selected or altered, as required.

It is of course possible to store in the cassette storage depository, 2, and in the bak note depository 5 valuable papers other than bank notes.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. Cashier's safe, characterized in that it comprises a bank note storage means (5) wherein storage units (4) are located at least on one side of the conveying path of a bank note conveyor (30, 31), and a bank note receiving and withdrawing point (7) is provided at one end of this conveying path; that the bank note conveyor (30, 31) is a covered belt conveyor with successive belt sections **(30*a*, 31*a*, 31*b*) respectively guided around two guide rollers (34*a*, 34*b*); that in each storage unit (4) two storage belts (36, 37) are individually guided by respectively one storage roller (38, 39) about one of the rolls of a roll pair (43, 44), are brought into contact in the roll nip thereof, are conducted in contact with each other to a storage drum (46), and are wound up thereon; and that beside a roll (43) of the roll pair (43, 44) of each storage unit (4), a guide roller (34*a*) of a belt section (31*a*) is arranged, and beside the other roll (44), a guide roller (34*b*) of a belt section (31*b*) directly following this belt section (31*a*) is disposed, pertaining to that (31) of the jointly traveling belts (30, 31) of the covered belt conveyor which runs on the side of the covered belt conveyor facing the roll pair (43, 44); that a switch (FIG. 6) is associated with the two guide rollers (34*a*, 34*b*) and the roll pair (43, 44), the guide members (51, 52, 53) of this switch engaging beside the guide rollers (34*a*, 34*b*) and rolls (43, 44) and being designed so that they conduct bank notes entrained between the belt sections of the covered belt conveyor and projecting therebeyond, in a first switch position, from one belt section (30*a*/31*a*) to the directly following section (30*a*/31*b*), and vice versa, respectively, and, in a second switch position, conduct such bank notes from one belt section (30*a*/31*a*) to the roll nip and vice versa, respectively; and that for the receiving and withdrawing of bank notes, the covered belt conveyor (30, 31) can be driven in the direction leading away from the bank note receiving and withdrawing point (7), or vice versa, and the storage drum (46) and/or the two storage drums (38, 39) of a selectable storage unit (4) can be respectively driven in the windup direction, and the switch (51, 52, 53) associated with this storage unit (4) can be placed into its second position and the switches arranged between this storage unit and the bank note receiving and withdrawing point (7)** can be placed into their first position.

2. Cashier's safe according to claim 1, characterized in that the two conveyor belts **(30, 30*a*, 31, 31*a*, 31*b*) of the covered belt conveyor and the storage belts (36, 37) are subdivided into belts running side-by-side; that, at least in the zone of the switches (FIG. 6), the guide rollers (33, 34, 34*a*, 34*b*) and preferably also the rolls (43, 44) are correspondingly subdivided; and that the switches exhibit guide members (51, 52, 53) that can be moved into the interspaces formed by this subdivision of the conveyor belts (30, 30*a*, 31, 31*a*, 31*b*), storage belts (36, 37), guide rollers (33, 34, 34*a*, 34*b*), and rolls (43, 44)**.

3. Cashier's safe according to claim 1, characterized in that, in the first switch position, at least one first guide member (51) of the switches (FIG. 6) is in the plane of the conveying faces of the belt sections **(31*a*, 31*b*) directly following each other at the storage unit (4) and, in the second switch position, is outside of the guide route thereof; that, in the second switch position, at least one second guide member (52) and a first portion of at least one third guide member (53) of the switches form a guide means leading between the interspace of the guide rollers (34*a*, 34*b*) and the roll nip of the roll pair (43, 44), and a second portion of the third guide member (53) which is curved with a radius that somewhat exceeds the radius of the guide roller (34*a*) closer to the bank note receiving and withdrawing point (7) is coaxial to this guide roller (34*a*); that the first guide member (51) is fixedly arranged at the free end of the second portion of the third guide member (53), and the guide members (51, 52, 53) are pivotable into the first and second switch position about axes arranged in the close proximity of the roll nip of the roll pair (43, 44)**.

4. Cashier's safe according to claim 1, characterized in that the velocity of the covered belt conveyor (30, 31) in the direction leading away from the bank note receiving and withdrawing point (7) is higher than in the direction leading to the bank note receiving and withdrawing point (7).

5. Cashier's safe according to claim 1 characterized in that the cashier's safe comprises a cassette storage means (2), preferably with two storage areas arranged in superposition on mutually opposite sides of the vertical traveling route (16) of the cassette carrier (17), and a bank note storage means (5), preferably with two storage units (4) disposed on both sides of the vertical covered belt conveyor **(30, 30*a*, 31, 31*a*, 31*b*)**.

* * * * *